US012359282B2

(12) United States Patent
Ishii

(10) Patent No.: US 12,359,282 B2
(45) Date of Patent: Jul. 15, 2025

(54) METHOD FOR MANUFACTURING Cu—Ni—Al-BASED SINTERED ALLOY

(71) Applicant: Diamet Corporation, Niigata (JP)

(72) Inventor: Yoshinari Ishii, Niigata (JP)

(73) Assignee: Diamet Corporation, Niigata (JP)

( * ) Notice: Subject to any disclaimer, the term of this patent is extended or adjusted under 35 U.S.C. 154(b) by 532 days.

(21) Appl. No.: 17/783,096

(22) PCT Filed: Dec. 11, 2020

(86) PCT No.: PCT/JP2020/046374
§ 371 (c)(1),
(2) Date: Jun. 7, 2022

(87) PCT Pub. No.: WO2021/117891
PCT Pub. Date: Jun. 17, 2021

(65) Prior Publication Data

US 2023/0002858 A1 Jan. 5, 2023

(30) Foreign Application Priority Data

Dec. 11, 2019 (JP) ..... 2019-223927

(51) Int. Cl.
*C22C 1/04* (2023.01)
*C22C 9/01* (2006.01)

(52) U.S. Cl.
CPC ..... *C22C 1/0425* (2013.01); *C22C 9/01* (2013.01)

(58) Field of Classification Search
CPC . C22C 1/0425; C22C 9/01; C22C 1/05; B22F 1/105; B22F 2009/041;
(Continued)

(56) References Cited

U.S. PATENT DOCUMENTS 4,365,996 A 12/1982 Melton et al.
5,545,487 A 8/1996 Ishijima et al.
2017/0328406 A1* 11/2017 Ito ..... C22C 9/01

FOREIGN PATENT DOCUMENTS

CN 110106393 A 8/2019
JP 56136942 A 10/1981
(Continued)

OTHER PUBLICATIONS

International Search Report mailed Jan. 26, 2021 for the corresponding International Patent Application No. PCT/JP2020/046374, 4 pages including English translation.
(Continued)

*Primary Examiner* — Anthony M Liang
*Assistant Examiner* — Danny N Kang
(74) *Attorney, Agent, or Firm* — Leason Ellis LLP; Melvin C. Garner; Mitsuhiro Haraguchi

(57) ABSTRACT

A method for manufacturing a Cu—Ni—Al-based sintered alloy according to the present invention includes: adding pure Al powder to alloy powder containing Cu, Ni, and Al and mixing them to produce raw material powder with a composition ratio of Ni: 1% to 15% by mass, Al: 1.9% to 12% by mass, and a Cu balance containing inevitable impurities; compacting the raw material powder to form a green compact; and sintering the green compact in a mixture gas atmosphere of hydrogen gas and nitrogen gas that contains 3% by volume or more of hydrogen gas.

8 Claims, 1 Drawing Sheet

(58) Field of Classification Search
CPC ..... B22F 2998/10; B22F 2999/00; B22F 3/1007; B22F 3/1028; B22F 5/106; B22F 9/04
See application file for complete search history.

(56) References Cited

FOREIGN PATENT DOCUMENTS

| | | | |
|---|---|---|---|
| JP | 11092846 | A | 4/1999 |
| JP | 2004068074 | A | 3/2004 |
| JP | 2006063398 | A | 3/2006 |
| JP | 2006199977 | A | 8/2006 |
| JP | 2010133016 | A | 6/2010 |
| JP | 2013217493 | A | 10/2013 |
| JP | 2015078432 | A | 4/2015 |
| JP | 2015227500 | A | 12/2015 |
| JP | 2016125079 | A | 7/2016 |

OTHER PUBLICATIONS

Chinese Office Action mailed Feb. 14, 2023 for the corresponding Chinese Patent Application No. 202080079214.6 (10 pages including English translation).
Indian Office Action mailed Oct. 20, 2022 for the corresponding Indian Patent Application No. 202217032306 (6 pages).

* cited by examiner

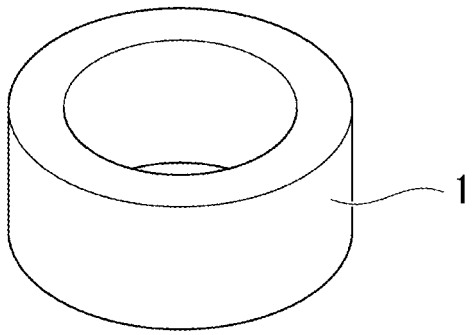
1

METHOD FOR MANUFACTURING Cu—Ni—Al-BASED SINTERED ALLOY

CROSS-REFERENCE TO RELATED PATENT APPLICATIONS

This application is a U.S. National Phase Application under 35 U.S.C. § 371 of International Patent Application No. PCT/JP2020/046374 filed on Dec. 11, 2020 and claims the benefit of priority to Japanese Patent Application 2019-223927 filed on Dec. 11, 2019, the contents of all of which are incorporated herein by reference in their entireties. The International Application was published in Japanese on Jun. 17, 2021 as International Publication No. WO/2021/117891 under PCT Article 21(2).

FIELD OF THE INVENTION

The present invention is used as a constituent material for sintered bearings of fuel pump used in fuel tanks of automobiles, exhaust valves used in high-temperature corrosive atmospheres such as exhaust gas, and bearings such as EGR (exhaust gas recirculation system). The present invention relates to a method for manufacturing a Cu—Ni—Al-based sintered alloy suitable for use.

BACKGROUND OF THE INVENTION

Engines including motor fuel pump using liquid fuel such as gasoline and light oil have been used all over the world. Bearings for the motor fuel pumps are required to have high slidability and abrasion resistance. Quality of liquid fuels used for the engines including the motor fuel pumps differ depending on areas.

In some areas in the world, coarse gasoline with poor quality containing sulfur, acids, and the like are used.

For the aforementioned reasons, the bearings used in the motor fuel pumps are required to have high corrosion resistance as well.

As examples of a bearing material for such applications, a bearing alloy made of a Cu—Ni-based sintered alloy with a composition of Cu-21% to 35% Ni-5% to 12% Sn-3% to 7% C-0.1% to 0.8% P by mass (see Japanese Unexamined Patent Application, First Publication No. 2006-199977 (A)), sintered aluminum bronze (see Japanese Unexamined Patent Application, First Publication No. 2013-217493 (A), Japanese Unexamined Patent Application, First Publication No. 2015-227500 (A) and Japanese Unexamined Patent Application, First Publication No. 2016-125079 (A)), and aluminum bronze containing Ni (see Japanese Unexamined Patent Application, First Publication No. 2016-125079 (A)) are known.

Similarly, as materials used in EGR bushes used in high-temperature corrosive environments of exhaust gas and the like, sintered sliding alloys obtained by dispersing free graphite in Cu—Ni—Sn-based solid solution or Cu—Ni—Sn—P-based solid solution matrixes (see Japanese Unexamined Patent Application, First Publication No. 2004-068074 (A) and Japanese Unexamined Patent Application, First Publication No. 2006-063398 (A)) are known, and adaption of aluminum bronze alloys has also been studied (see Japanese Unexamined Patent Application, First Publication No. 2016-125079 (A) and Japanese Unexamined Patent Application, First Publication No. 2015-078432 (A)).

CITATION LIST

Patent Documents

[Patent Document 1]
Japanese Unexamined Patent Application, First Publication No. 2006-199977 (A)
[Patent Document 2]
Japanese Unexamined Patent Application, First Publication No. 2013-217493 (A)
[Patent Document 3]
Japanese Unexamined Patent Application, First Publication No. 2015-227500 (A)
[Patent Document 4]
Japanese Unexamined Patent Application, First Publication No. 2016-125079 (A)
[Patent Document 5]
Japanese Unexamined Patent Application, First Publication No. 2004-068074 (A)
[Patent Document 6]
Japanese Unexamined Patent Application, First Publication No. 2006-063398 (A)
[Patent Document 7]
Japanese Unexamined Patent Application, First Publication No. 2015-078432 (A)

Technical Problem

Among these materials in the related art, it is possible to expect a corrosion resistance effect achieved by relatively reasonable Al from the aluminum bronze-based alloy used mainly for a sintered bearing of a fuel pump. Utilization of the aluminum bronze-based alloy enables reduction of the amount of added Ni that is expensive to 6% by mass or less and leads to material cost reduction.

However, since Al powder and alloy powder containing Al have a nature that they are easily oxidized, it is difficult to obtain a sintered body through sintering, and an improvement in a sinterability is a task.

In other words, since the Al powder or the alloy containing Al is likely to generate oxide coating on the surface thereof, and the oxide coating has high stability, presence of the oxide coating may be a factor of inhibiting the sinterability in a sintering atmosphere.

In order to improve the sinterability, fluoride such as aluminum fluoride or calcium fluoride is blended as a sintering aid in the raw material powder. Moreover, it is desirable that the molded article be sintered inside a box made of metal or the like. Also, it is necessary to add adjustment such as selection of gas that minimizes oxidation for a sintering protection atmosphere.

Therefore, according to the aforementioned method for improving sinterability, sintering efficiency is low, and sintering step cost increases. Moreover, there is a problem that if the sintering aid is decomposed during sintering, and fluorine gas is generated, there is a problem that deterioration of a sintering furnace material is accelerated.

As a result of the present inventor's intensive studies in order to improve sinterability of aluminum bronze in the aforementioned background, the present inventor discovered that adding pure Al powder to Cu—Ni—Al-based alloy powder containing Cu, Ni, and Al and mixing them to produce raw material powder was effective for improving sinterability of an aluminum bronze-based sintered alloy containing Ni. In other words, the present inventor discovered that if powder compacting molding was performed using the raw material powder to form a molded article, and the molded article was sintered in a mixture gas atmosphere of hydrogen gas and nitrogen gas that contains 3% by volume or more of hydrogen gas, then sintering advanced without addition of any sintering aid, and a sintered body with relatively high strength was able to be obtained.

Note that the present inventor also obtained knowledge that the strength of the sintered body was further improved if a sintering aid such as aluminum fluoride or calcium fluoride is used as needed.

The present invention was made in view of the circumstances described above, and an objective thereof is to provide a method for manufacturing a Cu—Ni—Al-based sintered alloy that enables sintering without using a sintering aid by a combination of Cu—Ni—Al-based alloy powder containing Cu, Ni, and Al and the pure Al powder as a method for manufacturing an aluminum bronze-based sintered alloy containing Ni.

SUMMARY OF THE INVENTION

Solution to Problem (1) In order to solve the problem, a method for manufacturing a sintered alloy according to an aspect of the present invention (hereinafter, referred to as a "method for manufacturing a sintered alloy according to the present invention") includes: adding a predetermined amount of the pure Al powder to Cu—Ni—Al-based alloy powder containing Cu, Ni, and Al and mixing them to produce raw material powder with a composition ratio of Ni: 1% to 15% by mass, Al: 1.9% to 15% by mass, and a Cu balance containing inevitable impurities; compacting the raw material powder to form a green compact; and sintering the green compact in a mixture gas atmosphere of hydrogen gas and nitrogen gas that contains 3% by volume or more of hydrogen gas.

The sintering atmosphere may be a reducing atmosphere containing 3% by volume or more of hydrogen gas and containing nitrogen gas. Examples of the reducing atmosphere include atmospheres of mixture gas of hydrogen gas and nitrogen gas and of mixture gas of hydrogen gas and nitrogen gas obtained by diluting, with nitrogen gas, decomposed ammonia gas (mixture gas of hydrogen gas and nitrogen gas manufactured by decomposing ammonia gas).

Note that for manufacturing a bearing product, sizing is performed after the sintering in the method for manufacturing a sintered alloy according to the present invention, and oil immersion of lubricant oil is then performed as needed.

(2) In the method for manufacturing a sintered alloy according to the present invention, the step of sintering may be performed in an atmosphere of a mixture gas of hydrogen gas and nitrogen gas, the mixture gas containing 3% by volume or more of hydrogen gas and being obtained by diluting a decomposed ammonia gas, which is made of hydrogen gas and nitrogen gas, with nitrogen gas.

The present inventor discovered that the green compact obtained through powder compacting molding using the raw material powder obtained by adding predetermined amounts of Cu—Ni—Al-based alloy powder containing Cu, Ni, and Al and the pure Al powder and mixing them has an effect that a sintering reaction of the Cu—Ni—Al-based alloy powder and the pure Al powder advances in the sintering step.

In other words, the combination of the Cu—Ni—Al-based alloy powder containing Cu, Ni, and Al and the pure Al powder is essential, and the sintering reaction hardly advances with other combinations, for example, a combination of Cu—Ni two-element alloy powder with no Al as a component of the alloy powder and the pure Al powder. The reason is considered as follows.

In the method for manufacturing a sintered alloy according to the present invention, the pure Al powder is melted at about 660° C. (that is a melting point of Al) in the process of a temperature rise to the sintering temperature of 880° C. to 1000° C. in the step of sintering the green compact made of the raw material powder as a combination of the Cu—Ni—Al-based alloy powder containing Cu, Ni, and Al and the pure Al powder, and a liquid phase is thus generated. The liquid phase has satisfactory wettability with a Cu—Ni—Al-based alloy powder surface containing Cu, Ni, and Al, and a sintering reaction through liquid phase sintering thus advances. On the other hand, if alloy powder that does not contain Al is used, it is considered that sintering is less likely to advance even in the liquid phase sintering state due to poor wettability with the liquid phase generated from the pure Al powder.

In a case in which the amount of added pure Al powder is small, an effect of promoting sintering through liquid phase sintering cannot be obtained, and targeted strength cannot be obtained. In a case in which the amount of added pure Al powder is too large, an Al-rich phase appears, and corrosion resistance deteriorates, which is not favorable.

Also, in order to cause the sintering to advance, it is important to perform the sintering in a reducing atmosphere of nitrogen gas containing 3% by volume or more of hydrogen gas (for example, a mixture gas atmosphere of hydrogen gas and nitrogen gas or a mixture gas atmosphere of hydrogen gas and nitrogen gas obtained by diluting decomposed ammonia gas (mixture gas of hydrogen gas and nitrogen gas obtained through decomposition of ammonia gas) with nitrogen gas). It is possible to cause sintering to advance with an oxide coating generated by the liquid phase generated from the pure Al powder on the surface of the alloy powder broken, by performing the sintering of the green compact made of the aforementioned raw material powder of the Cu—Ni—Al-based alloy powder containing Cu, Ni, and Al and the pure Al powder in the mixture gas atmosphere. It is thus possible to obtain a sintered alloy with high compressed environment strength.

(3) In the method for manufacturing a sintered alloy according to the present invention, a mixed powder containing the Cu—Ni—Al-based alloy powder containing Cu, Ni, and Al and the pure Al powder such that a content of the pure Al powder is 0.9% to 12% by mass may be used as the raw material powder.

(4) In the method for manufacturing a sintered alloy according to the present invention, a mixed powder containing Cu-1% to 15% Ni-1% to 12% Al alloy powder and 0.9% to 12% of the pure Al powder by mass may be used as the raw material powder.

(5) In the method for manufacturing a sintered alloy according to the present invention, a raw material powder containing 1.0% to 8.0% of graphite by mass in addition to the composition may be used as the raw material powder.

(6) In the method for manufacturing a sintered alloy according to the present invention, a raw material powder containing 0.1% to 0.9% of P by mass in addition to the composition may be used as the raw material powder.

(7) In the present invention, a raw material powder containing 0.02% to 0.2% of sintering aid made of at least one of aluminum fluoride and calcium fluoride by mass in addition to the composition may be used as the raw material powder.

(8) In the method for manufacturing a sintered alloy according to the present invention, a raw material powder to which at least one kind or two or more kinds of powders among a Ni powder, a Cu—P alloy powder, a Ni—P alloy powder, and a graphite powder are added in addition to the Cu—Ni—Al-based alloy powder containing Cu, Ni, and Al and the pure Al powder may be used as the raw material powder.

Advantageous Effects of Invention

In the method for manufacturing a sintered alloy according to the present invention, the pure Al powder promotes the sintering in the Cu—Ni—Al-based raw material powder containing Cu, Ni, and Al by becoming a liquid phase during the sintering with the Cu—Ni—Al-based alloy powder containing Cu, Ni, and Al and causing a reaction. It is thus possible to obtain a sintered alloy with high compressed environment strength and excellent abrasion resistance and corrosion resistance.

BRIEF DESCRIPTION OF THE DRAWING(S)

The FIGURE is a perspective view showing an example of a bearing part formed of a sintered alloy according to the present invention.

DETAILED DESCRIPTION OF THE INVENTION

Hereinafter, an embodiment of the present invention will be described with reference to the drawing.

The FIGURE shows a bearing part 1 with a cylindrical shape made of a sintered alloy according to the present embodiment, and the bearing part 1 is used as a bearing to be incorporated in a motor fuel pump for an engine or the like in one example.

The sintered alloy constituting the bearing part 1 has a composition containing Ni: 1% to 15% by mass and Al: 1.9% to 15% by mass and balances consisting of Cu and inevitable impurities.

Although not particularly limited, the sintered alloy constituting the bearing part 1 may have a composition containing Ni: 4% to 12% and Al: 5% to 14.5% by mass and balances consisting of Cu and inevitable impurities or may have a composition containing Ni: 6% to 11% and Al: 10% to 14% by mass and balances consisting of Cu and inevitable impurities.

As a texture of the sintered alloy constituting the bearing part 1, some sintered alloy has a sintered texture in which amorphous alloy grains containing Cu, Ni, and Al are bonded via a plurality of grain boundaries (including a binder phase consisting of pure Al).

Note that % for indicating content of elements means % by mass in the following description unless particularly indicated otherwise. Also, in a case in which an upper limit and a lower limit are defined using "to" for a content range of a specific element in the present specification, the range includes the upper limit and the lower limit unless particularly described otherwise. Therefore, 1% to 15% means 1% by mass or more and 15% by mass or less.

In order to manufacture the bearing part 1, pure Al powder is added to Cu—Ni—Al-based alloy powder containing Cu, Ni, and Al (for example, Cu—Ni—Al alloy powder) and is then mixed together, thereby producing raw material powder with a composition ratio of Ni: 1% to 15% by mass and Al: 1.9% to 15% by mass and balances consisting of Cu and inevitable impurities first in one example. As the raw material powder, mixed powder of Cu—Ni—Al alloy powder and the pure Al powder is used.

The Cu—Ni—Al alloy means alloy that contains a predetermined amount of Ni, a predetermined amount of Al, inevitable impurities, and Cu as a balance.

The Cu—Ni—Al-based alloy means a Cu—Ni—Al alloy which is alloy containing Ni, Al, Cu, and elements other than inevitable impurities.

As the Cu—Ni—Al alloy powder, it is possible to use Cu-1% to 15% Ni-1% to 12% Al alloy powder, for example. It is possible to prepare the mixed powder (raw material powder) by adding and mixing 0.9% to 12% of the pure Al powder with the alloy powder.

Note that it is also possible to use raw material powder containing 1.0% to 8.0% of C by mass in addition to the composition as the raw material powder used here. Addition of C can be achieved by mixing natural graphite powder with the raw material powder to obtain the aforementioned proportion, for example.

Hereinafter, reasons for limiting each composition ratio in the raw material powder in the present embodiment will be described.

"Content of the Pure Al Powder: 0.9% to 12%"

The pure Al powder becomes a liquid phase and reacts during sintering with the Cu—Ni—Al-based alloy powder containing Cu, Ni, and Al and contributes to promotion of sintering in the Cu—Ni—Al-based alloy powder. If the content of the pure Al powder with respect to the entire mixed powder (raw material powder) is less than 0.9%, a sintering promotion effect becomes insufficient, and desired hardness and strength of the sintered alloy cannot be obtained. On the contrary, in a case in which the content of the pure Al powder exceeds 12%, it is possible to expect the sinterability improving effect while an Al-rich phase appears in the texture, and corrosion resistance deteriorates, which is not favorable.

Although not particularly limited, the content of the pure Al powder with respect to the entire mixed powder (raw material powder) may be 3% to 10% or may be 4.5% to 8.5%.

Note that as the pure Al powder, it is possible to use powder manufactured by an atomizing method. Since there are air, nitrogen gas, and the like as fluids used in the atomizing method, inevitable impurities are mixed from impurities contained in oxygen and nitrogen, a furnace material used in the atomizing method, and the Al feed.

Since a small amount of oxygen in the pure Al powder leads to a higher sintering promotion effect, pure Al powder manufactured by the atomizing method using nitrogen gas is preferably employed. Also, it is possible to obtain the sinterability promotion effect even with pure Al powder obtained by the air atomizing method as long as it is possible to control it containing low oxygen depending on powder manufacturing conditions. Although it is possible to obtain the sintering promotion effect if the amount of oxygen in the pure Al powder is 0.2% or less, the amount of oxygen contained in the atomized powder is preferably 0.1% or less.

The content of Al contained in powder that can be used as the pure Al powder is 97% or more to 100%.

"Cu—Ni—Al-Based Alloy Powder Containing Cu, Ni, and Al"

As an example of the alloy powder containing Cu, Ni, and Al, it is possible to use a Cu—Ni—Al-based alloy powder. The Cu—Ni—Al-based alloy powder reacts with the liquid phase generated from the pure Al powder during sintering, and the sintering in the Cu—Ni—Al-based alloy powder is promoted.

The sintering promotion effect decreases, and desired hardness and strength cannot be obtained if the amount of Ni contained in the Cu—Ni—Al-based alloy powder is less than 1%, or the sintering promotion effect is saturated if Ni is added such that the amount thereof exceeds 15%. Since Ni is an expensive element, an increase in content of Ni leads to an increase in cost, which is not favorable.

Although not particularly limited, the amount of Ni contained in the Cu—Ni—Al-based alloy powder may be 4% to 12% or may be 6% to 11%.

It becomes difficult to obtain the sintering promotion effect if the amount of Al contained in the Cu—Ni—Al-based alloy powder is less than 1%, or desired strength of the sintered alloy cannot be obtained if the content of Al with respect to the entirety is less than 1.9%. If the content of Al contained in the Cu—Ni—Al-based alloy powder exceeds 12%, the alloy powder becomes hard, and compression moldability deteriorates, which is unfavorable. Although not particularly limited, the amount of Al contained in the Cu—Ni—Al-based alloy powder may be 4% to 12% or may be 6% to 11%. Therefore, it is desirable that the amount of Ni contained in the Cu—Ni—Al-based alloy powder fall within a range of 1% to 15% and that the amount of Al fall within a range of 1% to 12%. Note that it is possible to use Cu—Ni—Al-based alloy powder obtained by the atomizing method.

In addition, it is also possible to use raw material powder containing 0.1% to 0.9% of P by mass in addition to the composition as the raw material powder. In a case in which P is added to the raw material powder, it is possible to add Cu—P alloy powder and Ni—P alloy powder such that the content of P falls within a range of 0.1% to 0.9% with respect to the raw material powder.

Although not particularly limited, the content of P may be 0.2% to 0.6% or may be 0.3% to 0.5%.

P has a sintering promotion effect in the Cu—Ni—Al-based alloy powder. In a case in which addition is performed in the form of the Cu—P and Ni—P alloy powder, Cu-8% P is melted and becomes a liquid phase at about 714° C., Ni-11% P is melted and becomes a liquid phase at about 880° C. during the sintering, and the liquid phases have an action of further enhancing the sintering promotion effect of pure Al that has become a liquid phase earlier. In a case in which P is added, no sintering promotion effect is observed if the amount is less than 0.1%, or the sintering promotion effect is saturated if the amount of added P exceeds 0.9%, which are not favorable.

It is also possible to use raw material powder containing 0.02% to 0.2%, or more preferably 0.02% to 0.1% of sintering aid made of at least one of aluminum fluoride and calcium fluoride by mass in addition to the composition as the raw material powder. Aluminum fluoride and calcium fluoride react the Al oxide coating covering the surface of the Cu—Ni—Al powder, can remove it during the sintering, and can thus enhance the sintering promotion effect. However, the effect of enhancing sintering promotion is not observed if the amount of added aluminum fluoride and calcium fluoride is less than 0.02%. On the other hand, the effect of enhancing sintering promotion is saturated, and there is a concern that an influence of gas generated by fluorides increases if 0.2% or more fluorides are added, which are not favorable, and it is thus preferable not to add the fluorides or to minimize the amount of addition as much as possible.

In the present invention, it is also possible to use mixed powder obtained by adding at least one kind or two or more kinds of powders out of Ni—P alloy powder, a Cu—P alloy powder, aluminum fluoride powder, and calcium fluoride powder in addition to the Cu—Ni—Al alloy powder and the pure Al powder as the raw material powder.

In a case in which Ni powder is added to the raw material powder, it is possible to add Ni powder or Ni-11% P powder to the raw material powder such that the total amount in addition to the amount of Ni contained in the Cu—Ni—Al alloy powder is 15% or less.

In a case in which a mold lubricant such as zinc stearate powder or ethylene bisamide powder is added to the raw material powder, it is possible to add the metal die lubricant within a range of 1.5% or less to the raw material powder.

"Manufacturing Method"

Examples of the method for manufacturing a sintered alloy according to the present embodiment will be described later in detail. As an example of the embodiment of the invention of the present application, mixed powder obtained by mixing a necessary amount of the pure Al powder with Cu—Ni—Al-based alloy powder as base powder is used as the raw material powder. As the raw material powder, raw material powder to which the aforementioned additives are added may be used.

In a case in which the content of Ni in the raw material powder is increased, it is possible to add and mix Ni powder. Similarly, in a case in which C is contained, it is possible to mix natural graphite powder. Similarly, in a case in which P is contained, it is possible to mix Cu—P alloy powder or Ni—P alloy powder. In a case in which a sintering aid is contained, it is possible to mix aluminum fluoride powder or calcium fluoride powder. In a case in which the amount of added graphite is 4% by mass or less, it is possible to mix a lubricant in the powder form such as zinc stearate or ethylene bisamide.

In a case in which the raw material mixed powder is produced, it is preferable to use mixed powder with a particle size (D50) of about 10 to 90 μm.

After mixing the powder at predetermined proportions to obtain the aforementioned ranges, the powder is sufficiently mixed using a mixing machine such as a V-type mixer, thereby obtaining the raw material powder.

It is possible to fill a molding metal die with the raw material powder, to perform compression molding under a predetermined pressure, and thereby to obtain a molded article. Examples of the shape of the molded article include a ring shape.

Next, the molded article is accommodated in a heating furnace in which an atmosphere can be adjusted and is heated and sintered at a predetermined temperature in a predetermined atmosphere. As the atmosphere during the sintering, it is possible to use a mixture gas atmosphere of hydrogen gas and nitrogen gas that contains 3% by volume or more, for example, 5% to 15% by volume of hydrogen gas. Alternatively, it is possible to use a mixture gas atmosphere of hydrogen gas and nitrogen gas in which the proportion of hydrogen gas is adjusted to 3% by volume or more by diluting decomposed ammonia gas with nitrogen gas. The sintering temperature is 880° C. to 1000° C. and is more preferably 920° C. to 970° C.

If the temperature is slowly lowered after the sintering, an Ni—Al compound phase with high hardness is likely to precipitate, and initial conformability of a sliding member deteriorates. Therefore, it is preferable to raise the cooling speed after the sintering as much as possible. The preferable cooling speed is 10° C./minute or more.

After the cooling, the sintered body is subjected to sizing under a predetermined pressure. In one example of the present embodiment, it is possible to obtain the bearing part 1 made of a ring-shaped sintered alloy with predetermined outer diameter, inner diameter, and length by causing the sintered body after the cooling to be subjected to the sizing under the predetermined pressure.

The bearing part 1 made of the sintered alloy is a sintered alloy that has porosity of about 10% to 20% and has compressed environment strength that is strength as high as about 90 to 310 $N/mm^2$.

Also, the aforementioned sintered alloy is a sintered alloy that contains about 2% to 15% of Al, contains 1% to 15% of Ni, and thus has excellent corrosion resistance, and the bearing part 1 exhibits excellent corrosion resistance.

Therefore, if the bearing part 1 according to the present embodiment is used as a bearing for a motor fuel pump of an engine, there is an effect that it is possible to provide the bearing part 1 with excellent corrosion resistance and excellent durability with which it can be used for a long period of time even if it is used in an environment in which a large amount of impurities such as sulfur and organic acids are contained in a liquid fuel such as gasoline or light oil. According to the bearing part 1 in the present embodiment, it is possible to maintain excellent corrosion resistance through adjustment of the amount of added Al that is reasonable even if the amount of Ni contained in the sintered alloy is reduced to reduce cost. There is thus an effect that it is possible to provide a sintered alloy that is reasonable, has excellent corrosion resistance, and high strength.

Therefore, the aforementioned bearing part 1 has excellent corrosion resistance and durability even in a case in which it is applied to a bearing part for a motor fuel pump or the like of an engine and receives sliding of a shaft while being exposed to a corrosive fuel. Moreover, the bearing part 1 similarly has excellent corrosion resistance and durability even if it is applied to a bearing of an exhaust gas reflux system (EGR) exposed to a high-temperature exhaust gas.

Note that although the ring-shaped bearing part 1 is constituted using the aforementioned sintered alloy in the present embodiment, it is a matter of course that the sintered alloy in the present embodiment can widely be applied to a shaft member, a rod member, a bearing part, a plate, or the like provided in a nozzle mechanism or a valve mechanism.

It is a matter of course that the sintered alloy in the present embodiment can be used as a constituent material for various mechanism components provided in environments that are exposed to corrosive fluids, in addition to the utilization as the bearing part for a motor fuel pump of an engine.

Whether a sintered alloy or a sintered body made of the sintered alloy has been manufactured by the method for manufacturing a sintered alloy according to the present invention can be checked by analyzing the composition and the section of the sintered alloy or the sintered body made of the sintered alloy, for example.

It is possible to state that a sintered alloy or a sintered body made of the sintered alloy have been manufactured by the method for manufacturing a sintered alloy according to the present invention as long as the sintered alloy has a composition containing Ni: 1% to 15% by mass and Al: 1.9% to 15% by mass and balances consisting of Cu and inevitable impurities, a portion corresponding to the Cu—Ni—Al-based alloy powder in the section has a composition corresponding to the Cu—Ni—Al-based alloy powder used for the manufacturing, for example, the composition containing 1% to 15% of Ni, 1% to 12% of Al, and balances consisting of Cu and inevitable impurities, a portion corresponding to the binder phase derived from the pure Al powder has a composition corresponding to the pure Al powder used for the manufacturing, for example, a composition containing 15% or more of Al.

The composition of the sintered alloy or the sintered body made of the sintered alloy can be checked by a method used in the related art. For example, it is possible to check the composition by a high-frequency inductively coupled plasma emission analysis method (ICP emission analysis method) or an X-ray fluorescent method (XRF).

The compositions of a portion corresponding to the Cu—Ni—Al-based alloy powder and the portion corresponding to the binder phase derived from the pure Al powder in the sintered alloy or the sintered body made of the sintered alloy can be checked by analyzing the section by a method used in the related art. For example, it is possible to check the composition through energy dispersion-type X-ray analysis (EDX, EDS).

EXAMPLES

Although examples will be described below to describe the present invention in more detail, the present invention is not limited to these examples.

As raw material powder, −100 mesh alloy powder of each a Cu-5% Ni-5% Al alloy, a Cu-5% Ni-10% Al alloy, and a Cu-10% Ni-10% Al alloy, −200 mesh nitrogen gas atomized pure Al powder and air atomized pure Al powder, carbonyl Ni powder, −200 mesh Cu-8% P powder, −150 mesh scale graphite powder, and as sintering aids, aluminum fluoride with an average particle size of 10 μm and calcium fluoride powder with an average particle size of 1.5 μm were prepared.

Among these kinds of powders, a plurality of kinds of powders were mixed to obtain a predetermined proportion shown in each example in Table 1 below, 0.5% of ethylene bisamide powder was further added, the mixture was mixed for 20 minutes using a V-type mixer, thereby obtaining raw material powder.

The raw material powder was press-molded under a molding pressure of 196 to 686 MPa, thereby producing ring-shaped powder compacts.

Next, these powder compacts were sintered in a mixture gas atmosphere of hydrogen gas and nitrogen gas that contains 3% to 15% by volume of hydrogen gas using a mesh belt-type open furnace, thereby obtaining tubular sintered materials.

All the sintered materials were sized to a shape of bearing parts with an outer diameter of φ 10 mm, an inner diameter of φ 5 mm, and the entire length of 5 mm and were then subjected to each test, which will be described later.

In the previous examples, samples obtained by not adding sintering aids to raw material powder and samples obtained by adding sintering aids to the raw material powder were produced as shown in Table 1.

Also, as shown in Table 1, samples obtained by mixing graphite powder with the raw material powder, samples obtained by adding and mixing aluminum fluoride ($AlF_3$) powder and calcium fluoride ($CaF_2$) powder as sintering aids with the raw material powder, and samples obtained by adding and mixing Ni powder with the raw material powder were produced.

"Porosity"

Porosity was measured in accordance with the Archimedes method and the JIS Z2501:2000 sintered metal material-density, oil content, and open porosity test methods.

"Compressed Environment Strength"

A load was applied to the aforementioned bearing parts with the ring shape from a radial direction, and the test load when the samples were broken was regarded as a compressed environment strength. The compressed environment strength is preferably 80 MPa or more.

"Mass Change Rate in Corrosion Test"

A predetermined amount of carboxylic acid represented by RCOOH (R denote a hydrogen atom or a hydrocarbon group) was added to gasoline, thereby producing an organic acid test solution assuming pseudo coarse gasoline. The organic acid test solution was heated to 60° C., and the bearings in the examples of the present invention and the comparative examples were immersed in the organic acid test solution for 300 hours. Then, change rates between the masses of the bearings before the immersion in the organic acid test solution and the masses of the bearings after the immersion were measured.

Results of the above tests are shown in Tables 2 and 4 below, and the overall compositions (% by mass) of the blend raw material powder are shown in Table 5.

TABLE 1

| Bearing | | Blend composition of raw material powder (% by mass) | | | | | | | | |
|---|---|---|---|---|---|---|---|---|---|---|
| | | Cu—Ni—Al powder | Pure Al powder | Graphite powder | Sintering aid | Ni powder | Cu—P powder | Ni—P powder | Cu—Ni powder | Total |
| Example of present invention | 1 | Cu—5% Ni—5% Al: 87 | 8 | 5 | 0 | 0 | 0 | 0 | 0 | 100 |
| | 2 | Cu—5% Ni—10% Al: 93 | 2 | 5 | 0 | 0 | 0 | 0 | 0 | 100 |
| | 3 | Cu—10% Ni—10% Al: 92 | 3 | 5 | 0 | 0 | 0 | 0 | 0 | 100 |
| | 4 | Cu—5% Ni—5% Al: 83 | 8 | 5 | 0 | 4 | 0 | 0 | 0 | 100 |
| | 5 | Cu—5% Ni—5% Al: 90.9 | 4 | 5 | $AlF_3$: 0.05 $CaF_2$: 0.05 | 0 | 0 | 0 | 0 | 100 |
| | 6 | Cu—5% Ni—5% Al: 91.0 | 4 | 5 | $AlF_3$: 0.01 $CaF_2$: 0.01 | 0 | 0 | 0 | 0 | 100 |
| | 7 | Cu—5% Ni—5% Al: 90.8 | 4 | 5 | $AlF_3$: 0.1 $CaF_2$: 0.1 | 0 | 0 | 0 | 0 | 100 |
| | 8 | Cu—l % Ni—l% Al: 88.3 | 1 | 4 | 0 | 0.5 | Cu—8% P: 6.25 | 0 | 0 | 100 |
| | 9 | Cu—15 %Ni—12% Al: 95 | 1 | 4 | 0 | 0 | 0 | 0 | 0 | 100 |
| | 10 | Cu—1% Ni—12% Al: 86.8 | 4 | 3 | 0 | 5 | Cu—8% P: 1.25 | 0 | 0 | 100 |
| | 11 | Cu—15% Ni—l% Al: 81.3 | 12 | 3 | 0 | 0 | Cu—8% P: 3.75 | 0 | 0 | 100 |
| | 12 | Cu—10% Ni—10% Al: 91.6 | 2 | 0 | 0 | 0 | Cu—8% P: 3.75 | Ni—11% P: 2.7 | 0 | 100 |
| | 13 | Cu—10% Ni—10% Al: 88.5 | 2 | 1 | 0 | 0 | Cu—8% P: 2 | Ni—11% P: 6.5 | 0 | 100 |
| | 14 | Cu—10% Ni—10% Al: 91 | 2 | 7 | 0 | 0 | 0 | 0 | 0 | 100 |

TABLE 2

| Bearing | | Concentration of hydrogen gas in sintering atmosphere (%) | Sintering temperature (° C.) | Porosity (%) | Compressed environment strength ($N/mm^2$) | Mass change rate in corrosion test (%) |
|---|---|---|---|---|---|---|
| Example of present invention | 1 | 13 | 960 | 12.0 | 126 | −0.33 |
| | 2 | 13 | 920 | 11.3 | 117 | −0.16 |
| | 3 | 13 | 940 | 12.3 | 113 | −0.2 |
| | 4 | 13 | 930 | 13.3 | 172 | −0.29 |
| | 5 | 13 | 900 | 10.8 | 263 | −0.24 |
| | 6 | 13 | 920 | 11.2 | 151 | −0.22 |
| | 7 | 13 | 900 | 10.8 | 268 | −0.27 |
| | 8 | 8 | 950 | 14.5 | 187 | −0.58 |
| | 9 | 10 | 970 | 15.8 | 201 | −0.71 |
| | 10 | 5 | 970 | 13.5 | 193 | −0.45 |
| | 11 | 15 | 880 | 14.2 | 218 | −0.34 |
| | 12 | 3 | 950 | 11.8 | 310 | −0.46 |
| | 13 | 10 | 920 | 12.5 | 291 | −0.32 |
| | 14 | 10 | 1000 | 19.3 | 90 | −0.53 |

TABLE 3

| Bearing | | Blend composition of raw material powder (% by mass) | | | | | | | | |
|---|---|---|---|---|---|---|---|---|---|---|
| | | Cu—Ni—Al powder | Pure Al powder | Graphite powder | Sintering aid | Ni powder | Cu—P powder | Ni—P powder | Cu—Ni powder | Total |
| Comparative Example | 1 | 0 | 12 | 5 | 0 | 0 | 0 | 0 | Cu—10% Ni: 83 | 100 |
| | 2 | 0 | 8 | 5 | 0 | 4 | 0 | 0 | Cu—10% Ni: 83 | 100 |
| | 3 | Cu—10% Ni—0.5% Al: 94.7 | 0.3 | 5 | 0 | 0 | 0 | 0 | 0 | 100 |
| | 4 | Cu—10% Ni—0.5% Al: 75.3 | 1 | 5 | 0 | 0 | 18.8 | 0 | 0 | 100 |
| | 5 | Cu—0.5% Ni—10% Al: 94 | 2 | 4 | 0 | 0 | 0 | 0 | 0 | 100 |
| | 6 | Cu—5% Ni—14% Al: 92 | 4 | 4 | 0 | 0 | 0 | 0 | 0 | 100 |
| | 7 | Cu—10% Ni—10% Al: 95.5 | 0.5 | 4 | 0 | 0 | 0 | 0 | 0 | 100 |
| | 8 | Cu—10% Ni—2% Al: 81 | 15 | 4 | 0 | 0 | 0 | 0 | 0 | 100 |
| | 9 | Cu—10% Ni—10% Al: 87 | 4 | 9 | 0 | 0 | 0 | 0 | 0 | 100 |

TABLE 4

| Bearing | | Concentration of hydrogen gas in sintering atmosphere (%) | Sintering temperature (°C) | Porosity (%) | Compressed environment strength ($N/mm^2$) | Mass change rate in corrosion test (%) |
|---|---|---|---|---|---|---|
| Comparative Example | 1 | 13 | 960 | 18.6 | <40 | −11.2 |
| | 2 | 13 | 960 | 18.3 | <40 | −7.8 |
| | 3 | 13 | 920 | 17.2 | <40 | −9.4 |
| | 4 | 10 | 880 | 18.8 | <40 | −4.9 |
| | 5 | 13 | 920 | 19.8 | <40 | −2.3 |
| | 6 | 1 | 1030 | 20.7 | <40 | −1.8 |
| | 7 | 8 | 970 | 19.3 | <40 | −2.5 |
| | 8 | 5 | 850 | 15.4 | 187 | −4.7 |
| | 9 | 10 | 1000 | 16.6 | <40 | −0.78 |

TABLE 5

| Bearing | | Overall composition of blend raw material powder (% by mass) | | | | | | | | |
|---|---|---|---|---|---|---|---|---|---|---|
| | | Ni | Al | C | P | $AlF_3$ | $CaF_2$ | Bal. | Cu | Total |
| Example of present invention | 1 | 4.4 | 12.4 | 5 | 0 | 0 | 0 | 78.30 | Bal. | 100 |
| | 2 | 4.7 | 11.3 | 5 | 0 | 0 | 0 | 79.05 | Bal. | 100 |
| | 3 | 9.2 | 12.2 | 5 | 0 | 0 | 0 | 73.60 | Bal. | 100 |
| | 4 | 8.2 | 12.2 | 5 | 0 | 0 | 0 | 74.70 | Bal. | 100 |
| | 5 | 4.5 | 8.5 | 5 | 0 | 0.05 | 0.05 | 81.81 | Bal. | 100 |
| | 6 | 4.5 | 8.5 | 5 | 0 | 0.01 | 0.01 | 81.88 | Bal. | 100 |
| | 7 | 4.5 | 8.5 | 5 | 0 | 0.1 | 0.1 | 81.72 | Bal. | 100 |
| | 8 | 1.4 | 1.9 | 4 | 0.5 | 0 | 0 | 92.20 | Bal. | 100 |
| | 9 | 14.3 | 12.4 | 4 | 0 | 0 | 0 | 69.35 | Bal. | 100 |
| | 10 | 5.9 | 14.4 | 3 | 0.1 | 0 | 0 | 76.61 | Bal. | 100 |
| | 11 | 12.2 | 12.8 | 3 | 0.3 | 0 | 0 | 71.65 | Bal. | 100 |
| | 12 | 9.2 | 11.2 | 0 | 0.6 | 0 | 0 | 78.97 | Bal. | 100 |
| | 13 | 14.6 | 10.9 | 1 | 0.9 | 0 | 0 | 72.64 | Bal. | 100 |
| | 14 | 9.1 | 11.1 | 7 | 0 | 0 | 0 | 72.8 | Bal. | 100 |
| Comparative Example | 1 | 0.8 | 12.0 | 5 | 0 | 0 | 0 | 82.17 | Bal. | 100 |
| | 2 | 4.8 | 8.8 | 5 | 0 | 0 | 0 | 81.34 | Bal. | 100 |
| | 3 | 9.5 | 0.8 | 5 | 0 | 0 | 0 | 84.78 | Bal. | 100 |
| | 4 | 7.6 | 0.7 | 5 | 1.5 | 0 | 0 | 85.19 | Bal. | 100 |
| | 5 | 0.5 | 11.4 | 4 | 0 | 0 | 0 | 84.13 | Bal. | 100 |
| | 6 | 0.1 | 16.9 | 4 | 0 | 0 | 0 | 79.02 | Bal. | 100 |

TABLE 5-continued

| Bearing | Overall composition of blend raw material powder (% by mass) | | | | | | | | |
|---|---|---|---|---|---|---|---|---|---|
| | Ni | Al | C | P | $AlF_3$ | $CaF_2$ | Bal. | Cu | Total |
| 7 | 9.6 | 10.1 | 4 | 0 | 0 | 0 | 76.40 | Bal. | 100 |
| 8 | 8.1 | 16.6 | 4 | 0 | 0 | 0 | 71.28 | Bal. | 100 |
| 9 | 8.7 | 12.7 | 9 | 0 | 0 | 0 | 69.6 | Bal. | 100 |

According to the results described in Tables 1 to 5, it was possible to ascertain that sintering was able to be caused to advance and sintered alloys with high compressed environment strength and excellent corrosion resistance were able to be obtained, by mixing pure Al powder with Cu—Ni—Al alloy powder containing Cu, Ni, and Al to produce raw material powder with a composition ratio of Ni: 1% to 15% by mass and Al: 1.9% to 15% by mass and balances consisting of Cu and inevitable impurities and sintering green compacts using the raw material powder in the mixture gas atmosphere of hydrogen gas and nitrogen gas that contained 3% to 15% by volume of hydrogen gas.

On the other hand, the sample using the raw material powder obtained by adding graphite powder and Cu—Ni powder to pure Al powder without using Cu—Ni—Al alloy powder containing Cu, Ni, and Al had insufficient compressed environment strength and also had a high weight change rate in the corrosion test as shown in Comparative Example 1 shown in Tables 3 and 4. The sample using raw material powder obtained by adding graphite powder, Ni powder, and Cu—Ni powder to pure Al powder without using Cu—Ni—Al alloy powder as in Comparative Example 2 had insufficient compressed environment strength and had also a high weight change rate in the corrosion test.

Comparative Example 3 was a sample in which the content of Al in Cu—Ni—Al-based alloy powder was low and the amount of mixed pure Al powder was small, the compressed environment strength was insufficient, and the weight change rate in the corrosion test was also high due to the low content of Al in the entire blend raw material powder.

Comparative Example 4 was a sample in which the content of Al in Cu—Ni—Al-based alloy powder was low, the content of Al in the entire blend raw material powder was low, and a large amount of P was contained, the compressed environment strength was insufficient, and the weight change rate in the corrosion test was high.

Comparative Example 5 was a sample in which the content of Ni in Cu—Ni—Al-based alloy powder was low and the content of Ni in the blend raw material powder was low, the compressed environment strength was insufficient, and the weight change rate in the corrosion test was also slightly high.

Comparative Example 6 was a sample, in which the content of Al in Cu—Ni—Al-based alloy powder was high, which was produced under conditions that the amount of hydrogen in a sintering atmosphere was small and the sintering temperature was high, the compressed environment strength was insufficient, and the weight change rate in the corrosion test was also slightly high.

Comparative Example 7 was a sample in which the amount of mixed pure Al powder was small, the compressed environment strength was insufficient, and the weight change rate in the corrosion test was also slightly high.

Comparative Example 8 was a sample in which the amount of mixed pure Al powder was large, and the compressed environment strength was excellent while the weight change rate in the corrosion test was high.

Comparative Example 9 was a sample in which the amount of mixed graphite powder was large, and the compressed environment strength was degraded.

As is obvious from the comparison between the examples and the comparative examples, it was possible to ascertain that a sintered alloy with high compressed environment strength and excellent corrosion resistance was able to be obtained by adding pure Al powder to Cu—Ni—Al-based alloy powder containing Cu, Ni, and Al and mixing them to produce raw material powder with a composition ratio of Ni: 1% to 15% by mass and Al: 1.9% to 15% by mass and balances consisting of Cu and inevitable impurities, and sintering a green compact of the raw material powder in a mixture gas atmosphere of hydrogen gas and nitrogen gas that contained 3% by volume or more of hydrogen gas.

INDUSTRIAL APPLICABILITY

The pure Al powder becomes a liquid phase during sintering, reacts with the Cu—Ni—Al-based alloy powder containing Cu, Ni, and Al, and promotes sintering in the Cu—Ni—Al-based raw material powder containing Cu, Ni, and Al. It is thus possible to obtain a sintered alloy with high compressed environment strength and excellent abrasion resistance and corrosion resistance.

REFERENCE SIGNS LIST

1: Bearing part

What is claimed is:

1. A method for manufacturing a Cu—Ni—Al-based sintered alloy, the method comprising the steps of:

adding a predetermined amount of a pure Al powder to a Cu—Ni—Al-based alloy powder containing Cu, Ni, and Al and mixing thereof to produce a raw material powder with a composition including Ni: 1% to 15% by mass, Al: 1.9% to 15% by mass and a balance being Cu and inevitable impurities;

compacting the raw material powder to form a green compact; and sintering the green compact in a mixture gas atmosphere of hydrogen gas and nitrogen gas that contains 3% by volume or more of hydrogen gas.

2. The method for manufacturing a Cu—Ni—Al-based sintered alloy according to claim 1, wherein the step of sintering is performed in an atmosphere of a mixture gas of hydrogen gas and nitrogen gas, the mixture gas containing 3% by volume or more of hydrogen gas and being obtained by diluting a decomposed ammonia gas, which is made of hydrogen gas and nitrogen gas, with nitrogen gas.

3. The method for manufacturing a Cu—Ni—Al-based sintered alloy according to claim 1, wherein a content of the pure Al powder is 0.9% to 12% by mass in the raw material powder.

4. The method for manufacturing a Cu—Ni—Al-based sintered alloy according to claim 1, wherein the Cu—Ni—Al-based alloy powder includes Ni: 1% to 15% by mass, Al: 1% to 12% by mass, and a balance being Cu and inevitable impurities, and a content of the pure Al powder is 0.9% to 12% by mass in the raw material powder.

5. The method for manufacturing a Cu—Ni—Al-based sintered alloy according to claim 1, wherein 1.0% to 8.0% by mass of graphite is further added to produce the raw material powder.

6. The method for manufacturing a Cu—Ni—Al-based sintered alloy according to claim 1, wherein 0.1% to 0.9% by mass of P is further added to produce the raw material powder.

7. The method for manufacturing a Cu—Ni—Al-based sintered alloy according to claim 1, wherein 0.02% to 0.2% by mass of sintering aid made of at least one of aluminum fluoride and calcium fluoride is further added to produce the raw material powder.

8. The method for manufacturing a Cu—Ni—Al-based sintered alloy according to claim 1, wherein at least one or more powders selected from the group consisting of a Ni powder, a Cu—P alloy powder, a Ni—P alloy powder, and a graphite powder is further added to produce the raw material powder.

* * * * *